US005709286A

United States Patent [19]

Mead et al.

[11] Patent Number: 5,709,286

[45] Date of Patent: Jan. 20, 1998

[54] MECHANICAL REPLACEMENT FOR HYDRAULIC IN-GROUND VEHICLE LIFT

[75] Inventors: Roy W. Mead, Beavercreek; Richard J. Wourms, Brookville; Ronald W. Hamm, Medway, all of Ohio

[73] Assignee: Joyce/Dayton Corp., Kettering, Ohio

[21] Appl. No.: 645,113

[22] Filed: May 13, 1996

[51] Int. Cl.[6] ..... B66F 7/00

[52] U.S. Cl. ..... 187/205; 254/92

[58] Field of Search ..... 187/203, 205, 187/210, 267, 268, 215; 254/98, 89 R, 92

[56] References Cited

U.S. PATENT DOCUMENTS

| | | | |
|---|---|---|---|
| 2,530,137 | 11/1950 | Wallace | 254/89 |
| 4,644,811 | 2/1987 | Tervo | 187/267 |
| 4,669,166 | 6/1987 | Grimes | 29/401.1 |
| 4,741,084 | 5/1988 | Ronk | 29/401.1 |
| 5,036,951 | 8/1991 | Frangos | 187/8.59 |
| 5,404,968 | 4/1995 | Fletcher | 187/205 |
| 5,469,936 | 11/1995 | Lauga et al. | 187/205 |
| 5,573,083 | 11/1996 | Fletcher et al. | 187/205 |

*Primary Examiner*—Kenneth Noland
*Attorney, Agent, or Firm*—Biebel & French

[57] ABSTRACT

An in-ground mechanical vehicle lift apparatus including an outer cylinder and a support tube rigidly attached to the outer cylinder. A ram cylinder is located between the outer cylinder and support tube in telescoping relationship to the outer cylinder and the support tube. The drive motor is mounted to the ram cylinder and a drive screw is operably connected to the drive motor for engaging a nut rigidly attached to an upper end of the support tube. The drive screw is driven in rotation by the motor to cause the ram cylinder to move upwardly and downwardly relative to the outer cylinder, and a vehicle support portion is located on an upper end of the ram cylinder for engaging and supporting a vehicle. The lift apparatus is adapted to be installed as a replacement for an in-ground hydraulic lift system wherein the lift apparatus is of a compact design which will fit within an existing in-ground cylinder of the hydraulic system.

20 Claims, 4 Drawing Sheets

76
58
74
70
72
12
30
66
46
62
10
68
42
26
36
44
34
16
60
14

MECHANICAL REPLACEMENT FOR HYDRAULIC IN-GROUND VEHICLE LIFT

BACKGROUND OF THE INVENTION

This invention relates to a replacement for hydraulic in-ground vehicle lifts and, more particularly, to a mechanical replacement cartridge which may be installed in place of a hydraulic piston lift.

If has been found that in-ground installed hydraulic lifts, such as those used to raise vehicles, have created an environmental hazard caused by seepage of hydraulic fluid into the ground from leaking hydraulic jacking units and hydraulic pumping units. The hydraulic fluid (pressurized to 200–300 psi), which is usually petroleum- based oil, contaminates the ground adjacent to the lifts. This environmental problem is particularly significant because of the large number of lifts presently installed in many major maintenance facilities for vehicles in the United States.

The lifts used in most facilities are generally movable piston lift systems including a movable front jacking unit and a fixed rear jacking unit. The front jacking unit is slidably mounted on a floor frame enabling the unit to be moved to accommodate different wheelbases. The floor frame is affixed to the top of a concrete pit which surrounds a downwardly extending cylinder of the front jacking unit.

As seen in FIG. 1, the rear jacking unit includes a rearjacking unit cylinder 10 wherein the top of the cylinder is anchored in concrete 12 which is typically approximately six inches thick. The bottom of the cylinder 10 is supported by a concrete footer 14 and concrete is generally poured around the bottom of the cylinder on top of the footer to a height of six to twelve inches. The area between the top and bottom of the cylinder is usually filled with sand or gravel 16. In addition, an outer steel casing 18 may also be provided surrounding the sand or gravel 16 such that ground contamination will be delayed until the outer casing begins to deteriorate because of corrosion. A piston 20 is located within the cylinder 10 and is actuated for vertical movement by hydraulic fluid supplied to the cylinder. A superstructure 22 is located on the top of the piston 20 for engaging the bottom of a vehicle during a lifting operation.

As an alternative to hydraulic systems, mechanical systems, such as electrically powered screw jack systems have been proposed for use in in-ground installations. Such mechanical systems avoid the environmental problems associated with contamination from hydraulic fluids. However, the mechanical systems proposed are generally designed for use in new installations, or in installations which are remodeled to remove the hydraulic installation prior to installation of the mechanical system. Thus, replacement of the imbedded or fixed jacking unit has proven to be inconvenient and expensive in that such an operation requires extensive concrete removal and expensive reinstallation to accommodate the mechanical unit.

Accordingly, there is a need for a less expensive, easily installed mechanical replacement for hydraulic in-ground vehicle lift systems.

SUMMARY OF THE INVENTION

The present invention provides a vehicle lift apparatus for converting a hydraulically operated vehicle lift to a mechanically operated vehicle lift. The vehicle lift apparatus of the present invention is adapted to replace a hydraulic lift of the type having a cylindrical support cylinder buried below a ground surface and a piston guided for vertical movement within the support cylinder by bearings on an interior surface of the support cylinder.

In preparation for installing the present invention, the piston of the hydraulic lift is removed from the support cylinder and bearings on the support cylinder are bored out to a predetermined diameter whereby the mechanically operated lift assembly may be inserted into the support cylinder.

The mechanical lift apparatus of the present invention includes an outer cylinder forming a casing or housing for the apparatus and forming a generally cylindrical casing interior defining a central axis. A drive support is located within the casing interior and a ram member is supported by the drive support wherein the ram member includes a vehicle support portion for engaging and supporting a vehicle during a vehicle lifting operation.

A first drive member is supported on the drive support and a second drive member supported on the ram member cooperates with the first drive member such that relative movement between the first and second drive members causes the ram member to move up and down relative to the outer cylinder. In addition, a driver is provided for driving one of the first and second drive members in movement relative to the other of the drive members, and the driver is positioned such that the central axis of the outer cylinder extends through the driver.

In a further aspect of the invention, the first drive member comprises a threaded nut and the second drive member comprises a threaded screw, and the driver includes a reversible electric or pneumatic motor and speed reducing unit. The motor causes the threaded screw to rotate relative to the nut such that the ram member is actuated for movement in a vertical direction. In a preferred embodiment, the drive support comprises a tubular member having a square cross-section and the ram member includes a cylindrical body having an interior surface mounting plate members or bearing plates for engaging the sides of the square tube. The bearing plates prevent rotation between the square tube of the drive support and the cylindrical body of the ram member during rotation of the threaded screw.

The lift apparatus is designed as a cartridge assembly adapted to easily fit within an existing in-ground cylinder. Accordingly, the lift apparatus may be installed into existing facilities without requiring excavation to remove the previous lift assembly.

Therefore, it is an object of the present invention to provide a mechanical lift assembly to replace an existing in-ground hydraulic lift assembly.

It is a further object of the invention to provide such a lift assembly wherein the mechanical lift may be installed directly within an existing in-ground cylinder provided for the hydraulic lift assembly.

It is another object of the invention to provide such a mechanical lift assembly wherein all of the drive components are configured to fit within the in-ground cylinder when the lift assembly is in a lowered position.

Other objects and advantages of the invention will be apparent from the following description, the accompanying drawings and the appended claims.

DETAILED DESCRIPTION OF THE PREFERRED EMBODIMENT

Figure 1:
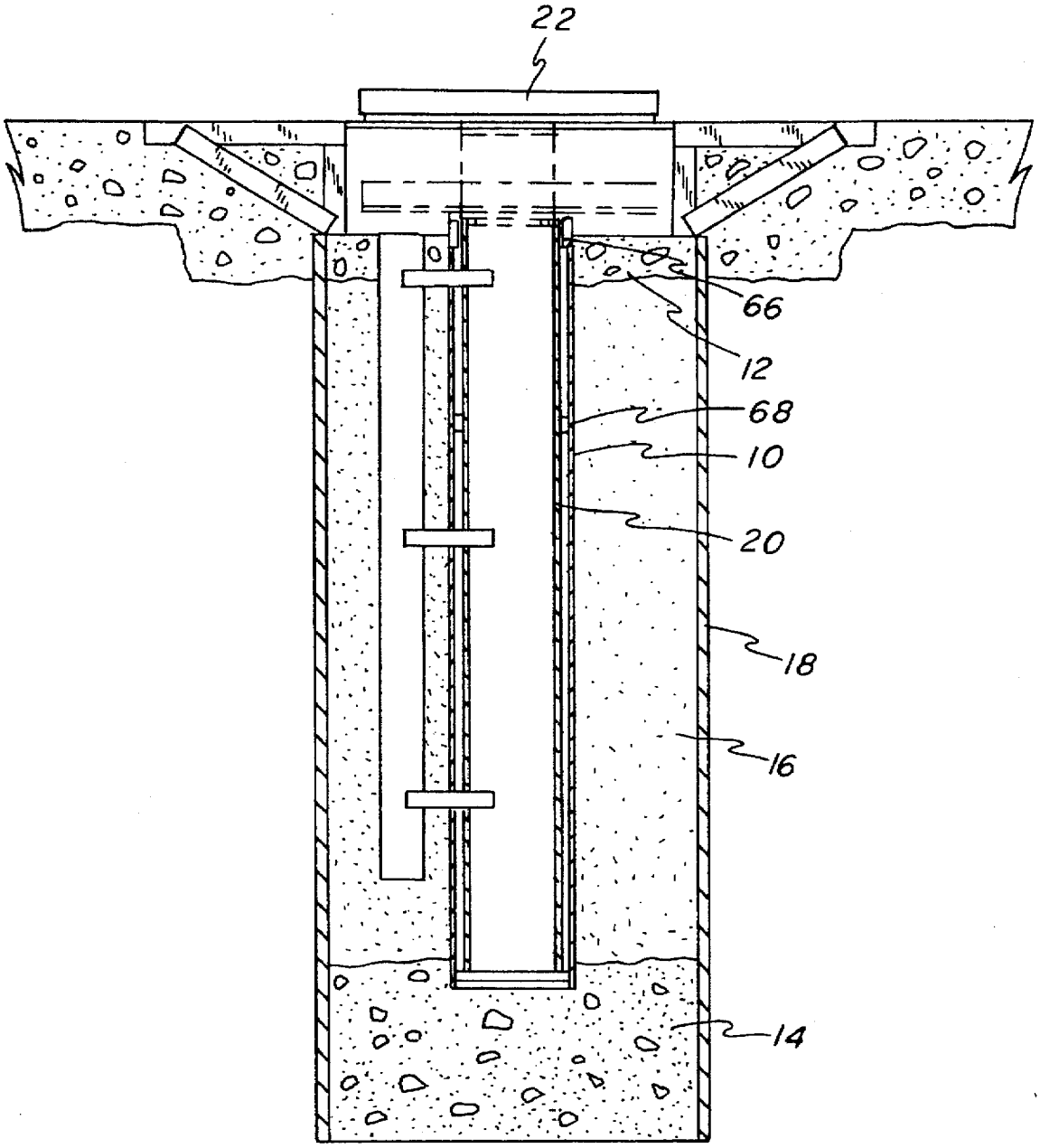
FIG-1 PRIOR ART
FIG. 1 is a side elevational view taken along a cross-section of a prior art hydraulic lift installation.

The present invention relates to a mechanical lift apparatus in the form of a mechanical cartridge replacement for a hydraulic lift system, such as is shown in FIG. 1. The existing hydraulic systems typically include an in-ground casing 10, and the present lift apparatus cartridge is adapted to be positioned within the in-ground casing 10.

Figure 2:
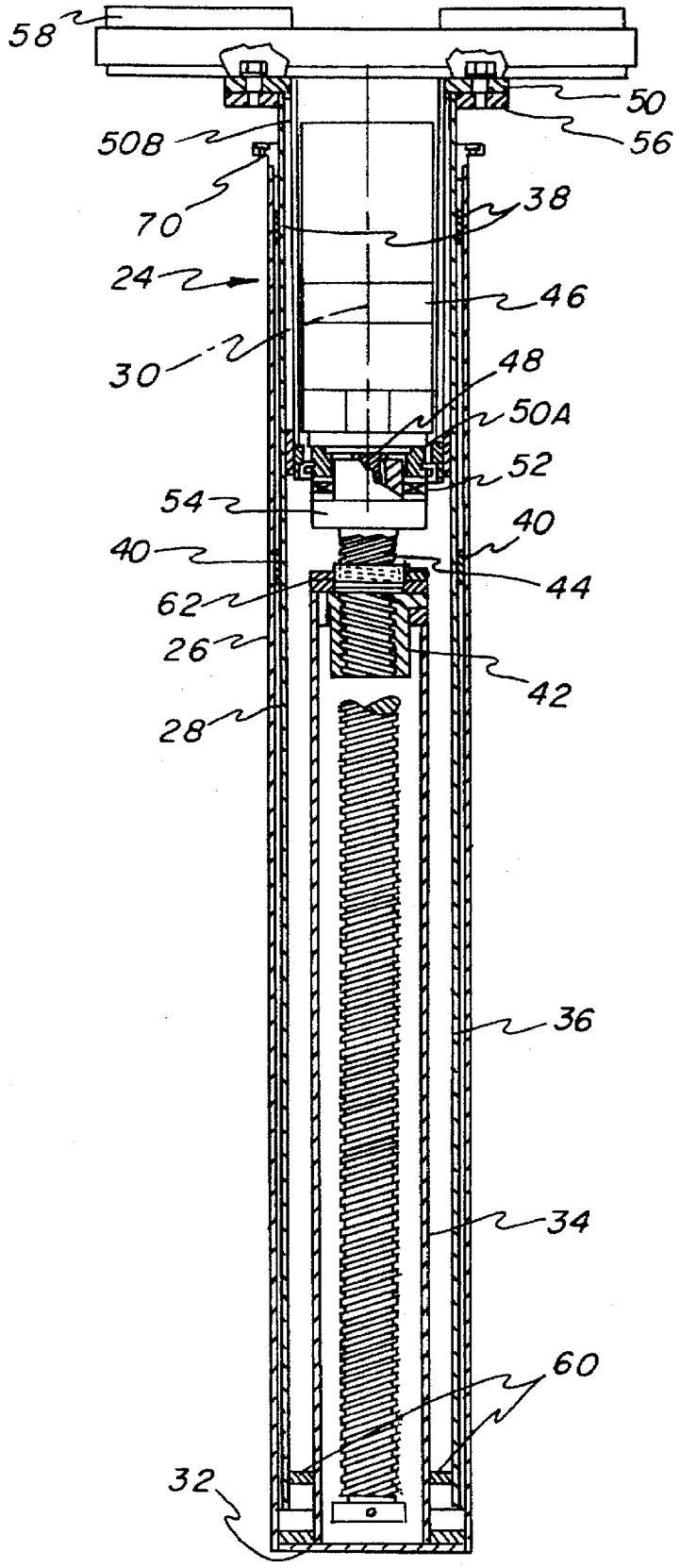
FIG. 2 is a partial cross-sectional view of the present mechanical vehicle lift apparatus.

Referring to FIG. 2, the vehicle lift apparatus or cartridge 24 of the present invention includes a cylindrical outer cylinder 26 defining a casing interior 28 and further defining a longitudinal axis 30 extending centrally through the casing interior 28. The outer cylinder 26 includes a lower end wall 32 located at a lower end thereof. A support tube 34 is rigidly attached to the lower end wall 32 and extends upwardly through the casing interior 28. The support tube 34 preferably has a square cross-section, as viewed in a plan view, and is located substantially centrally within the interior 28 aligned with the axis 30.

A ram cylinder 36 is positioned in telescoping relationship within the outer cylinder 26 and is located between the outer cylinder 26 and the support tube 34. Bearing members 38, 40 mounted on the interior of the outer cylinder 26 facilitate positioning and guiding the ram cylinder 36 in its vertical movement relative to the outer cylinder 26.

A drive assembly is provided for driving the ram cylinder 36 in vertical movement, the drive assembly including a first drive member in the form of a threaded nut 42 rigidly attached to an upper end of the support tube 34, and a second drive member in the form of a threaded screw 44 which is threadably engaged with the nut 42. In a lowered position of the ram cylinder 36, the threaded screw 44 extends downwardly through the support tube 34 to a location adjacent to the end wall 32 of the outer cylinder 26.

The drive assembly further includes a driver 46 comprising a motor and speed reducer assembly wherein an output shaft 48 of the driver 46 is connected to the screw 44 for driving the screw 44 in rotating movement relative to the nut 42. The driver 46 preferably includes a reversible electric or pneumatic motor for driving the output shaft 48 in opposite directions to raise and lower the ram cylinder 36. The driver 46 is attached to the ram cylinder 36 at a plate 50A located on an upper end of the ram cylinder 36, and an anti-friction thrust bearing 52 transfers loads transmitted from the plate 50A through the driver 46 to a shoulder 54 on the screw 44. A plate 50 is attached to the upper end of the ram cylinder 36 at a flange 56 and is connected to plate 50A by cylinder 50B. A vehicle support portion or superstructure 58 is bolted to the upper end of the ram cylinder 36 for engaging and supporting a vehicle. Thus, the driver 46 acts as a load bearing member aligned along the axis 30 for transferring loads through the screw 44 and the nut 42 to the support tube 34.

In order to ensure that the ram cylinder 36 does not rotate with rotation of the screw 44, engagement portions comprising four bearing plates 60 (only two shown) are rigidly mounted to interior surfaces of the ram cylinder 36 in slidable engagement with respective sides of the square support tube 34. The bearing plates 60 may be adjustable to compensate for any manufacturing tolerances of the support tube 34. It should be noted that rotation of the ram cylinder 36 may alternatively be prevented by providing the support tube 34 as a keyed cylinder, or by a conventional mechanism such as an external non-rotating device associated with the hydraulic lift assembly replaced by the present mechanical assembly.

A follower nut 62 is installed above the nut 42 and is located above the nut 42 a distance equal to the wear limit of the threads on the screw 44. When the threads of the nut 42 wear to a maximum allowable limit, the load transmitted by the screw 44 is carried on the follower nut 62. However, when a load is imposed on the follower nut 62, the load can be lowered on the next down cycle but can not be raised until the worn nut 42 is replaced. This result is produced by forming the follower nut 62 with a slip rachet mechanism that permits only unidirectional rotation when a vertical load is placed on the follower nut 62.

Figure 3:
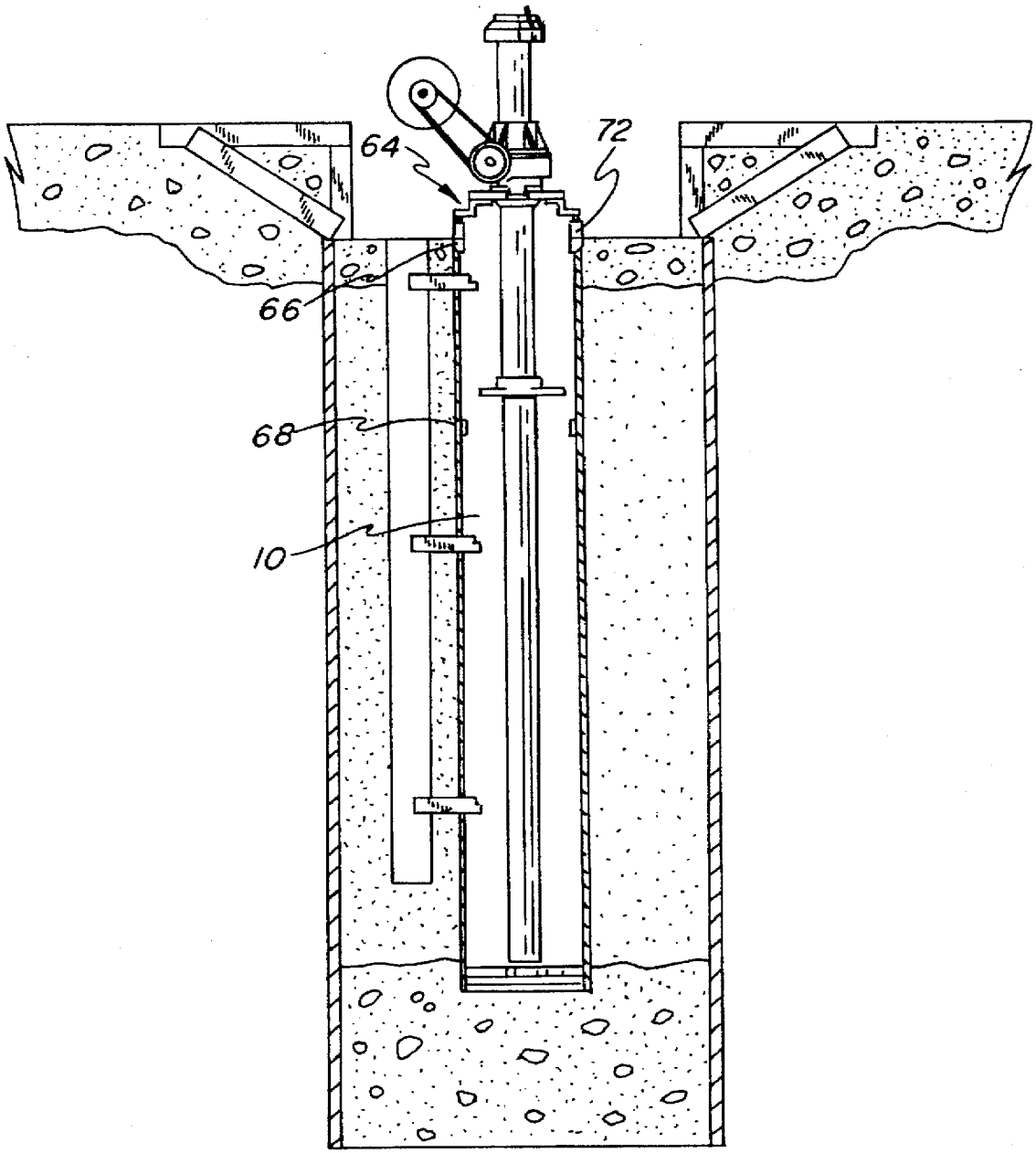
FIG. 3 is a side elevational view similar to FIG. 1 wherein the hydraulic lift components have been removed and showing an operation of boring out the top and bottom bearing rings or bearings of the existing cylinder.

In converting a hydraulic lift assembly installation to receive the present mechanical vehicle lift apparatus, the piston of the hydraulic assembly is removed, leaving behind the in-ground cylinder 10. As seen in FIG. 3, a boring tool 64 is then mounted to the top of the in-ground cylinder 10 and extending into the in-ground cylinder 10 to bore out the top and bottom bearing rings 66, 68 located within the in-ground cylinder 10 such that the inner diameters of the rings 66, 68 are sized to accommodate the outer diameter of the outer cylinder 26 of the assembly 24.

Figure 4:
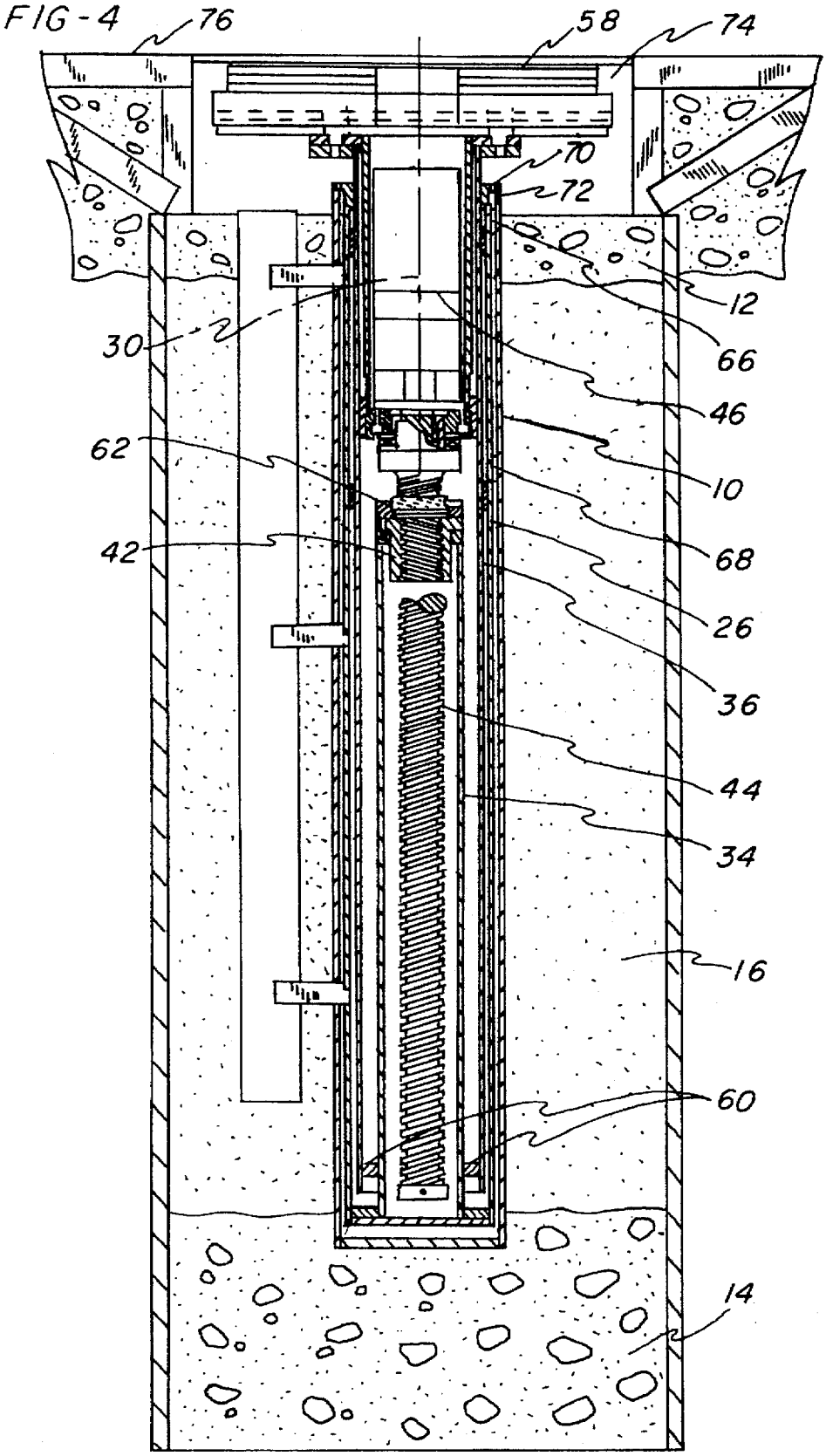
FIG. 4 is a side elevational view showing a cross-section of a vehicle lift installation with the mechanical vehicle lift apparatus of the present invention installed.

With the in-ground cylinder 10 thus conditioned to receive the mechanical vehicle lift apparatus 24, the apparatus 24 may be inserted downwardly within the in-ground cylinder 10, as illustrated in FIG. 4. The lift apparatus 24 is then attached to the upper edge of the in-ground cylinder 10 by bolting a flange 70 of the outer cylinder 26 to a cylinder bolt ring or flange 72 on an upper edge of the in-ground cylinder 10. Thus, the present lift assembly is capable of being rigidly attached in an in-ground installation without requiring removal of the existing in-ground cylinder remaining from the previous hydraulic lift system.

It should be noted that in some cases the bearings 66, 68 between the piston 20 and cylinder 10 (FIG. 1) may be removable. In such cases, the boring step would not be required and the lift apparatus 24 may be inserted into the in-ground cylinder after removal of the bearings 66, 68.

Further, it should be noted that the present apparatus is formed of a compact construction wherein all of the drive components are adapted to fit within a space defined by the ram cylinder and in-ground cylinder, and that the vehicle support portion 58 may be positioned within an existing recess 74 defined at the installation site below the ground level 76 as a result of the drive components not requiring additional space outside of the existing in-ground cylinder 10.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A vehicle lift apparatus comprising:

an outer cylinder forming a casing interior defining a central axis;

a drive support located within said casing interior;

a ram member supported by said drive support, said ram member including a vehicle support portion for engaging and supporting a vehicle during a vehicle lifting operation;

a first drive member supported on said drive support;

a second drive member supported on said ram member and cooperating with said first drive member whereby relative movement between said first and second drive members causes said ram member to move up and down;

a driver for driving one of said first and second drive members in movement relative to the other of said first and second drive members; and wherein said driver is positioned such that said central axis extends through said driver.

2. The apparatus of claim 1 wherein said driver comprises a motor and said longitudinal axis extends through said motor.

3. The apparatus of claim 2 wherein said first drive member comprises a threaded nut and said second drive member comprises a threaded screw.

4. The apparatus of claim 1 wherein said driver is mounted to said ram member for movement through said outer cylinder.

5. The apparatus of claim 4 wherein said driver is located between said vehicle support portion and said drive support.

6. The apparatus of claim 5 wherein said driver comprises a reversible electric or pneumatic motor.

7. The apparatus of claim 1 wherein said drive support comprises a tubular member located within said casing interior and rigidly attached to said outer cylinder.

8. The apparatus of claim 7 wherein said tubular member includes an outer engagement surface and said ram member includes engagement portions located in engagement with said outer engagement surface to prevent rotation of said ram member relative to said drive support.

9. The apparatus of claim 1 including an in-ground cylinder wherein said outer cylinder is located within said in-ground cylinder.

10. The apparatus of claim 9 wherein said outer cylinder includes a casing flange portion and said in-ground cylinder includes an upper end portion, and said casing flange portion is connected to said upper end portion.

11. An in-ground vehicle lift apparatus comprising:

a cylindrical outer cylinder defining a casing interior;

a support tube located in said casing interior and rigidly attached to said outer cylinder;

a ram cylinder located between said outer cylinder and said support tube;

a drive motor mounted to said ram cylinder;

a drive screw operably connected to said drive motor;

a nut rigidly attached to said support tube and threadably engaged with said drive screw; and a vehicle support portion located on said ram cylinder for engaging and supporting a vehicle wherein said drive motor actuates said drive screw in rotating movement to move said ram cylinder up and down within said outer cylinder.

12. The apparatus of claim 11 wherein said drive motor is movable through said outer cylinder during movement of said ram cylinder.

13. The apparatus of claim 11 wherein said outer cylinder defines a central longitudinal axis and said drive motor is located along said axis.

14. The apparatus of claim 11 wherein said support tube includes an outer surface defining means for cooperating with said ram cylinder to prevent rotation of said ram cylinder relative to said support tube.

15. The apparatus of claim 11 wherein said support tube includes an outer surface defining a square cross-section and a said ram cylinder includes plate members extending radially inwardly into engagement with said outer surface to thereby prevent rotation of said ram cylinder relative to said support tube.

16. The apparatus of claim 11 including an in-ground cylinder surrounding said outer cylinder wherein said in-ground cylinder forms a support for said outer cylinder.

17. The apparatus of claim 16 wherein said outer cylinder includes an upper casing end and a casing flange attached to said upper casing end, and said in-ground cylinder includes an upper cylinder end wherein said casing flange is bolted to said upper cylinder end.

18. A method of converting a hydraulically operated vehicle lift to a mechanically operated vehicle lift, the hydraulic vehicle lift being of the type having a cylindrical in-ground cylinder buried below a ground surface and a piston guided for vertical movement within the in-ground cylinder by bearings on an interior surface of the in-ground cylinder, the method comprising the steps of:

removing the piston from the in-ground cylinder; and inserting a mechanically operated vehicle lift into said in-ground cylinder, said mechanically operated lift including on outer cylinder, a ram cylinder movable within said outer cylinder and including a vehicle engaging portion for supporting a vehicle in vertical movement, and a motor for driving said ram cylinder in vertical movement.

19. The method of claim 18 further comprising the step of rigidly attaching said outer cylinder to said in-ground cylinder.

20. The method of claim 18 further comprising the step of boring out the bearings on the in-ground cylinder to a diameter matching an outer diameter of said outer cylinder.

* * * * *